United States Patent [19]

Gottermeier

[11] 4,076,532

[45] Feb. 28, 1978

[54] THERMOSENSITIVE IMAGE-FORMING ELEMENT AND METHOD OF PROCESSING THEREOF

[75] Inventor: William F. Gottermeier, Rochester, N.Y.

[73] Assignee: Eastman Kodak Company, Rochester, N.Y.

[21] Appl. No.: 649,604

[22] Filed: Jan. 16, 1976

[51] Int. Cl.[2] ..... G03C 5/24; G03C 1/78

[52] U.S. Cl. ..... 96/48 HD; 250/316; 96/87 R; 428/910; 428/913; 428/213; 428/339; 428/480

[58] Field of Search ..... 96/48 HD, 87 R, 1.1; 250/316; 428/480, 483, 913, 213, 216, 334, 339, 910; 260/2.5, 75 TN; 427/322, 148; 350/3.5; 346/77 E

[56] References Cited

U.S. PATENT DOCUMENTS

| | | | |
|---|---|---|---|
| 2,779,684 | 1/1957 | Alles | 428/483 |
| 3,447,927 | 6/1969 | Bacon et al. | 96/87 R |
| 3,595,836 | 7/1971 | Korneli et al. | 260/75 TN |
| 3,887,787 | 6/1975 | Gregg | 96/48 HD |
| 3,957,515 | 5/1976 | Robillard | 96/48 HD |

FOREIGN PATENT DOCUMENTS

| | | | |
|---|---|---|---|
| 1,000,361 | 8/1965 | United Kingdom | 260/75 TN |

*Primary Examiner*—Won H. Louie, Jr.
*Attorney, Agent, or Firm*—T. N. Dahl

[57] ABSTRACT

A thermosensitive image-forming element is comprised of at least one image-forming layer and a biaxially-oriented heatset poly(ethylene terephthalate) film support which is capable of resisting dimensional distortion resulting from the combined effects of tension and heat. The element is processed by application of heat sufficient to form a visible image while maintaining the element under tension in its longitudinal dimension and no tension in its transverse dimension.

14 Claims, 3 Drawing Figures

THERMOSENSITIVE IMAGE-FORMING ELEMENT AND METHOD OF PROCESSING THEREOF

FIELD OF THE INVENTION

This invention relates to a thermosensitive image-forming element having a poly(ethylene terephthalate) film support which expands in its transverse dimension and shrinks in its longitudinal dimension when heated and cooled in the unrestrained state and to a method for processing thereof. When such an element is processed to form a visible image by the application of heat and unidimensional tension in its longitudinal dimension, and thereafter cooled, undesirable necking in the transverse dimension is reduced.

DESCRIPTION OF THE ART

As an alternative to conventional chemical development of images in photographic elements, image in certain recording elements can be formed by the application of heat. An element so processable may be characterized as thermosensitive, including, for example, photothermographic and thermographic.

For a typical process of forming a visible image on a thermosensitive element, such an element is prearranged in end-to-end relationship with other such elements into a continuous web. Thereafter, the continuous web is processed, whereby each element is transported through a heating zone and raised to a high temperature, usually 140° C or more, to initiate the image development mechanism. In conjunction with the transportation of the web through the heating zone, a typical process utilizes a number of idler rolls upon which the web is guided and supported. To rotate these rolls — hence decreasing the likelihood of damage to the web passing thereupon — tension is applied to the web in its direction of movement (longitudinal direction), thereby providing the necessary force to overcome the inertia and friction of the rolls. Tension is provided, for example, by passing the web over variably-weighted "float" rolls suitably located in line with the idler rolls. The longitudinal tension thus produced in the web may vary in a preselected amount from 50 to 600 psi, depending on the web thickness and the amount of weight added to the float rolls.

In the foregoing process, when the support for the web is poly(ethylene terephthalate), temperatures employed invariably exceed the second order transition temperature ($T_g$) of the polymeric support. When poly(ethylene terephthalate) film has been biaxially oriented, as hereinafter described, its $T_g$ is about 100° C. At temperatures above this level, it is vulnerable to certain distorting effects of heat developing processes. In particular, longitudinal tension on the web in such processes tends to contract the transverse dimension (both the longitudinal and transverse dimensions referred to herein are in the major plane of the film). Transverse contraction is commonly referred to as "necking" or "neck-in" and is believed to be a compensating reaction of the web to tension applied in the longitudinal dimension. In any event, after the web is cooled, the residual effect of the necking is a distortion in dimensions which is undesirable in thermosensitive elements. While the amount of necking that can be tolerated is a matter of user preference, it is frequently desirable that the element be processed with either no change in its transverse dimension or less change than would ordinarily occur therein as a result of unrestrained necking.

Necking can be eliminated or offset by several known techniques, all of them suffering certain significant disadvantages. For example, the poly(ethylene terephthalate) can be replaced with a polymer having a $T_g$ exceeding the temperatures within the range in which the thermosensitive element is processed. Such polymers, however, are expensive and difficult to manufacture.

Another method for minimizing necking provides for grasping and restraining the lateral edges of the web as it traverses the high temperature development zone, thereby holding the transverse dimension constant. This often requires, however, that the web have wasteful larger edge margins and/or specifically configured edge bead formations. Edgewise restraint may also damage the web within the high temperature zone. Furthermore, the presence of restraining apparatus within this zone makes the process more complicated to adjust, and consumes more space.

Poly(ethylene terephthalate) films have been prepared with improved thermal stability in both the mutually perpendicular dimensions of the film's major plane. For example, in U.S. Pat. No. 2,899,713 (Lundsager), a poly(ethylene terephthalate) film treating method is described wherein the resulting film exhibits in its major plane 0 percent changes in one dimension and 0.6 percent shrinkage in the perpendicular dimension, when subjected to the free-shrinkage test described therein. In the method of U.S. Pat. No. 2,779,684 (Alles), a poly(ethylene terephthalate) film is manufactured having substantially no dimensional shrinkage in its major plane dimensions when allowed to shrink freely at 120° C as described therein. These films, however, require at least edgewise restraint to reduce necking when subjected to the aforementioned processing of thermosensitive elements.

SUMMARY OF THE INVENTION

A thermosensitive image-forming element and method of heat processing the element have now been discovered which wholly or partially eliminate undesirable necking without resort to edgewise restraint. This is accomplished, in accordance with the invention, by employing a biaxially-oriented, heatset poly(ethylene terephthalate) film support having properties as hereinafter described, for the thermosensitive element. This film support is unique in that it shrinks in its longitudinal dimension and expands in its transverse dimension when subjected to a destructive test comprising holding the support in the unrestrained state while heating it to a temperature which is at least 100° but no greater than 230° C, and thereafter cooling. A thermosensitive element comprising such a support is heat processed to form a visible image according to the invention by heating the element at a processing temperature of at least 100° but no greater than 230° C while applying tension to the film support in its longitudinal dimension and substantially no tension in its transverse dimension, and thereafter cooling to below 100° C. The processing temperature is selected such that when the film support is destructively tested (as described herein) at the processing temperature, it exhibits shrinkage in its longitudinal dimension and expansion in its transverse dimension.

BRIEF DESCRIPTION OF THE DRAWINGS

In the detailed description of the preferred embodiments of the invention presented below, reference is made to the accompanying drawings in which.

DESCRIPTION OF THE PREFERRED EMBODIMENTS

Figure 3:
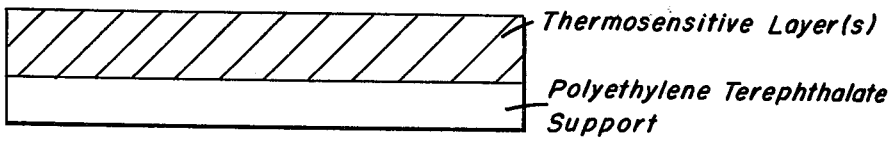
FIG. 3 represents a thermosensitive element in accordance with the invention.

The present invention provides a thermosensitive image-forming element and a method of forming a visible image in the element. As shown in FIG. 3, such an element typically comprises at least one thermosensitive layer on a biaxially-oriented, heatset poly(ethylene terephthalate) film support. The emulsions and associated addenda which comprise typical thermosensitive layers can be determined from the exemplary references cited hereinafter, bearing in mind that such layers must be capable of forming a visible image within the temperature range of the method of the invention.

Figure 1:
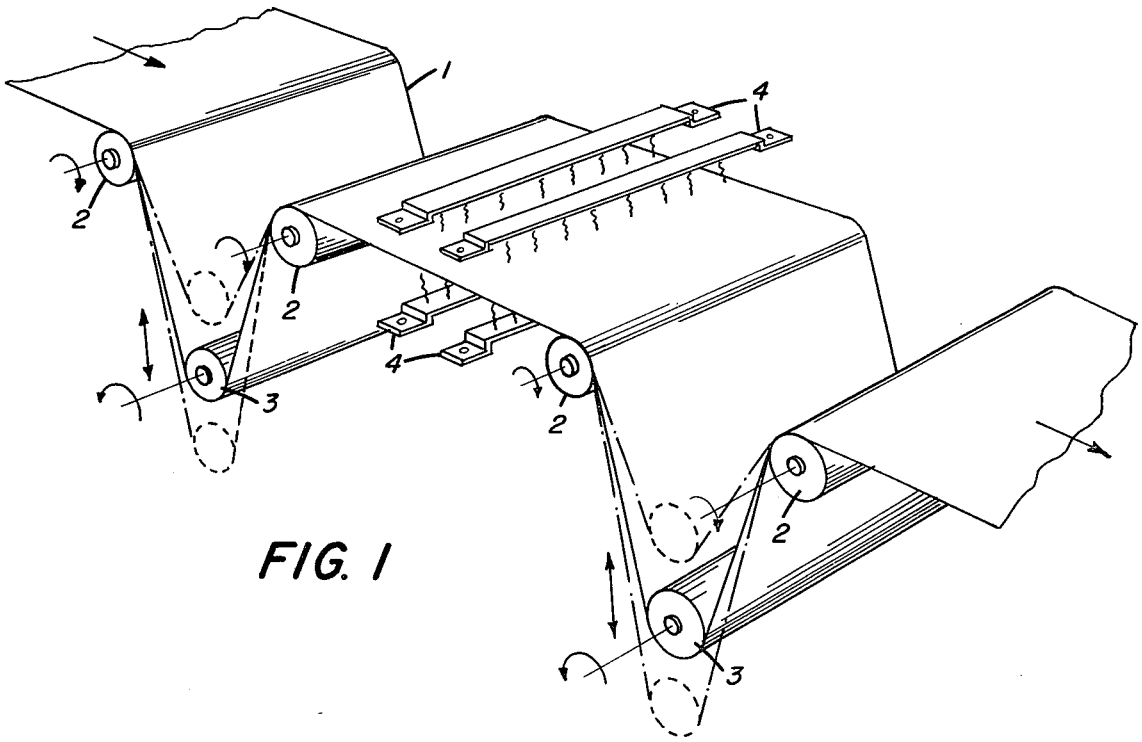
FIG. 1 is a schematic of a web of thermosensitive elements being processed at high temperatures and unidirectional tension according to the invention.

Elements as illustrated in FIG. 3 are typically arranged in end-to-end relationship as a continuous web 1, as shown in FIG. 1. A visible image on each element is formed by raising the temperature of web 1 to an appropriate processing temperature within the shown high temperature zone. To support and guide the advancing web 1 into and out of the high temperature zone, idler rolls 2 are provided. In order to rotate idler rolls 2 synchronously with moving web 1, tension is applied to the web in the direction of web movement (longitudinal dimension) by means of variably weighted float rolls 3 placed in line with idler rolls 2. Longitudinal tensions encountered, depending on the web thickness and amount of weight on float rolls 3 range preferably from about 50 to about 600 psi. Most preferred longitudinal tensions range from about 300 to about 500 psi. In general, a thinner web 1 will require more tension to provide the necessary force to rotate idler rolls 2. However, as shown in FIG. 1, in the width or transverse dimension of web 1, there is no restraint as it passes through the high temperature zone.

Within the high temperature zone of FIG. 1, web 1 is raised to and maintained at a processing temperature, $T_p$, by means of one or more heating means 4. Heating may be provided by any known manner, for example, by convection, conduction, or radiation. A processing temperature for a thermosensitive element may typically vary from 80° to 250° C, depending on the materials selected. However, for the purpose of the invention, the temperature range is modified so that $T_p$ is in the range from 100° C to a second higher temperature, $T_2$ which does not exceed 230° C. $T_2$ is related to the unique physical properties of the poly(ethylene terephthalate) film supporting the thermosensitive element of the invention, and is described in greater detail hereinafter. A preferred $T_p$ is in the range from about 150° to about 200° C and a most preferred $T_p$ is in the range from about 175° to about 185° C. Within these preferred ranges $T_p$ is less than $T_2$, preferably by from 10° to 20° C.

After elements on web 1 have been processed to a visible image within the higher temperature zone, web 1 is advanced through a cooling zone to reduce the temperature of the web to below 100° C. Cooling may be effected by any known means. Invariably, ambient temperatures in this region provide sufficient cooling. Factors which influence cooling are, for example, residence time of web 1 in the cooling region, and web thickness.

Figure 2:
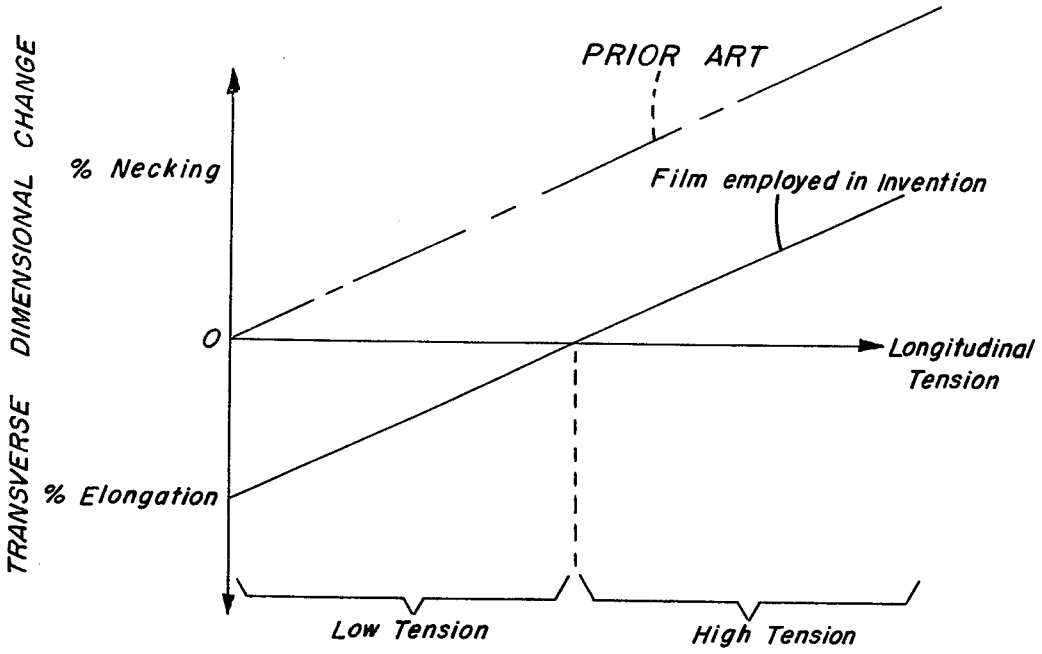
FIG. 2 is a graph of transverse dimensional change versus tension in the longitudinal dimension of a film support employed in the invention compared to a prior art film support after processing according to the invention.

When heat-processed in accordance with the above method, thermosensitive elements described herein are uniquely capable of wholly or partially offsetting the necking tendency of a second (transverse) dimension perpendicular to a first (longitudinal) dimension in which tension is applied. This capability, furthermore, may be realized without imposing any restraint on the element in the transverse dimension. As shown in the graph of FIG. 2, such an element, when processed at a suitable $T_p$ and longitudinal tension as described, can be expected to exhibit in its transverse dimension a complete offsetting of necking at low longitudinal tensions, and partial offsetting at high longitudinal tensions. The terms "high" and "low" longitudinal tension may be defined, in this regard, as the longitudinal tension above and below that point at which an element of the invention exhibits substantially no transverse necking when processed as above. In contrast to the instant element, a prior art element having similar thermosensitive layers on a poly(ethylene terephthalate) film support, when subjected to identical processing conditions may be expected to exhibit necking at both high and low longitudinal tension (FIG. 2).

Neck-resistant image-forming thermosensitive elements employed in the invention comprise, in addition to one or more thermosensitive layers, a biaxially-oriented, heatset poly(ethylene terephthalate) film support having certain unique physical properties. In particular, in the support's major plane, its longitudinal dimension exhibits shrinkage and its transverse dimension perpendicular to the longitudinal exhibits elongation when the support is subjected to the following identifying destructive "free shrinkage" test:

(1) maintaining the film support unrestrained for six seconds at a temperature in the range from about 100° C to a second higher temperature, $T_2$, not exceeding 230° C, and (2) thereafter cooling the film support to below 100° C.

$T_2$, as used herein, refers to that temperature above which the film support first begins to exhibit shrinkage in the transverse dimension after step (2) of the test. One practicing the invention may conveniently determine the test temperature range by subjecting a sample of the film to the above destructive test employing first a test temperature slightly higher than 100° C, for example 105° C, and noting the dimensional change of the transverse dimension, compared to the same dimension before so testing. If the transverse dimension after the test is larger (indicating expansion), the test is repeated destructively on untested samples at progressively higher test temperatures until the transverse dimension of a sample after testing is smaller (indicating shrinkage). The temperature above which shrinkage in the transverse dimension first occurs is $T_2$.

One practicing the invention can expect—when performing the above destructive test—to observe varying degrees of shrinkage in the longitudinal dimension and expansion in the transverse dimension. Poly(ethylene terephthalate) film supports manufactured according to the techniques described below exhibit from about 0.1 percent to about 1.3 percent expansion in the transverse dimension and from about 0.2 percent to about 3.3 percent shrinkage in the longitudinal dimension.

The above poly(ethylene terephthalate) film properties are particularly advantageous in the process according to the invention, when temperatures from 100° C to $T_2$ are employed. If temperatures above $T_2$ are used, the film support—hence the thermosensitive element formed therefrom—loses its ability to expand in the transverse dimension. It is essential that such expansion in the transverse dimension be retained in order to counteract necking which tends to occur in that dimension while the element traverses the high temperature zone of FIG. 1 under tension in the longitudinal dimension. Furthermore, depending on the particular user requirements, by varying the amount of longitudinal tension (see FIG. 2), a preselected level of—including zero—necking can be produced.

Film supports described above can be manufactured by heatsetting a biaxially-oriented poly(ethylene terephthalate) film support and simultaneously permitting its transverse dimension to shrink at a uniform rate while holding the longitudinal dimension constant. Manufacturing processes of this general type are described, for example, in British Pat. No. 1,000,361 (Toyo Rayon Kabushiki Kaisha; published Aug. 4, 1965). This patent sets forth a method of treating a polyester film wherein a heat treated biaxially oriented poly(ethylene terephthalate) film is permitted to relax along its transverse dimension from 2 to 30 percent at a temperature in the range from 150° to 250° C. Heatsetting, as used herein, applies to the well-known heat treatment of biaxially stretched films to fix the orientation of the polymer molecules. Useful heatsetting conditions are preselected to increase the density of the biaxially-oriented film to a range from about 1.3850 to about 1.3950 gms/cc. Parameters which may be varied to give the indicated density range are heatsetting temperature and residence time. Representative heatsetting temperatures are from about 175° to about 225° C or more. Residence times of the film support within the heatsetting zone may vary from about 6 to about 17 seconds.

In one method of manufacture of the instant film support, the transverse film dimension is permitted to shrink at a constant rate during the entire heatsetting operation to a total shrinkage of from 10 percent to 16 percent or more. A preferred shrinkage range is from 14 percent to 16 percent. An alternative method provides for the same heatsetting parameters as above except that during the first half of the heatsetting operation, both the longitudinal and transverse film dimensions are maintained constant, after which transverse dimension shrinkage at a constant rate is permitted in the indicated amounts for the remainder of the operation. A method of heatsetting generally similar to this alternative method is described in British Pat No. 1,040,612 (Kalle Aktiengesellschaft; published Sept. 1, 1966). In this patent, heatsetting film webs includes, in part, heating the web to above a stretching temperature while maintaining its transverse dimension constant and thereafter permitting the width to shrink from 1 percent to 10 percent or more.

The poly(ethylene terephthalate) film support above described, is biaxially-oriented or stretched prior to heatsetting, in any well-known manner so that the longitudinal and transverse dimensions are from about 2.5 to about 3.5 times greater than their unstretched magnitude. Poly(ethylene terephthalate) films which have been so oriented may be identified, as well as their degree of orientation determined, by x-ray diffraction, birefringence, or infrared dichroism analysis as described in "Structured Polymer Properties", by Robert W. Samuels, John Wiley & Sons, Inc., 1974.

The heat-sensitive layer or layers employed in the practice of this invention include those well known to those skilled in the art and can be processed by imagewise or overall application of heat. Suitable heat processable elements can comprise one or more image-forming layers which can be processed by heat to form visible images. Typical heat-sensitive layers and ancillary addenda that can be used in this invention include those which form visible images by thermographic and photothermographic means as described in U.S. Pat. Nos. 2,910,377; 1,916,302; 3,447,927; 3,312,550; 2,933,289; 3,392,020; 3,152,903; 3,152,904; and in the following publications of Research Disclosure: Volume 105 (January 1973), Item 10513; Volume 117 (January 1974), Item 11709; Volume 125 (September 1974), Items 12542 an 12537.

The above principles and the invention are illustrated but not limited by the following examples:

EXAMPLE 1

A continuous web of 4.0 mil thick biaxially-oriented poly(ethylene terephthalate) film having a stretch ratio (the ratio of a stretched film dimension to the unstretched same dimension) of about 3 in both its longitudinal dimension and transverse dimension, is continuously advanced longitudinally through a heatsetting zone wherein the film is heated for about 17 seconds. The temperature at which the film is heated to therein is varied between about 175° and about 225° C or slightly higher to produce heatset films of correspondingly varied densities ranging from about 1.3850 to about 1.3950 gms/cc. Throughout the entire length of the heatsetting zone, the transverse film dimension is permitted to shrink at a uniform rate to a total shrinkage of 15 percent. A uniform rate of shrinking is achieved by converging the straight rails guiding the clamps engaging the lateral edge of the moving web. To hold the longitudinal dimension of the web constant, the longitudinal spacing between adjacent guide clamps is fixed. After heatsetting, the web is cooled to below 100° C and suitably wound on a storage core.

Samples of the heatset film of varied densities are next subjected to the aforementioned destructive identifying test comprising heating each sample without restraint at selected temperatures starting at 100° C. The dimensional change of each sample, measured and determined as percent elongation (+) or shrinkage (−), compared to the untested sample, is recorded. Table I indicates the results.

Table I

| Sample | Density (gms/cc) | Test Temperature (° C) | % Dimensional Change Transverse | % Dimensional Change Longitudinal |
|---|---|---|---|---|
| 1 | 1.3850 | 100 | +0.2 | −0.2 |
| | | 125 | +0.3 | −0.6 |
| | | 150 | +0.6 | −1.0 |
| | | 170 | +0.5 | −1.5 |
| | | 180 | +0.2 | −1.7 |
| | | 190 | −0.8 | −2.5 |
| 2 | 1.3900 | 100 | +0.1 | −0.2 |
| | | 125 | +0.2 | −0.6 |
| | | 150 | +0.4 | −1.2 |

Table I-continued

| Sample | Density (gms/cc) | Test Temperature (° C) | % Dimensional Change Transverse | Longitudinal |
|---|---|---|---|---|
| | | 170 | +0.6 | −1.5 |
| | | 180 | +0.7 | −1.4 |
| | | 190 | +0.7 | −2.2 |
| | | 200 | +0.6 | −2.5 |
| | | 210 | +0.3 | −1.8 |
| | | 220 | −1.6 | −4.0 |
| 3 | 1.3950 | 100 | +0.2 | −0.4 |
| | | 125 | +0.3 | −0.7 |
| | | 150 | +0.5 | −1.0 |
| | | 170 | +0.7 | −1.2 |
| | | 180 | +0.7 | −1.4 |
| | | 190 | +0.9 | −1.7 |
| | | 200 | +1.0 | −2.0 |
| | | 210 | +1.2 | −2.0 |
| | | 220 | +1.3 | −2.8 |
| | | 230 | +0.6 | −3.3 |
| | | 235 | −0.1 | — |

Useful results are also obtainable when poly(ethylene terephthalate) films are permitted, during heatsetting as above, to uniformly shrink transversely from above 10 percent to about 17 percent or higher. In this regard, it has been noted that at about 10 percent or less shrinkage levels, the advantages of the invention are not obtainable.

Particularly useful results are obtainable for biaxially-oriented poly(ethylene terephthalate) films having thicknesses ranging from about 1.0 mil (0.001 inch) to about 8.0 mils (0.008 inch), when heatset and permitted to transversely shrink as described. Most preferred thicknesses range from about 2.5 mils (0.0025 inch) to about 4.0 mils (0.004 inch).

As can be seen, $T_2$ as defined herein, is slightly above 180°, 210°, and 230° C for, respectively, samples 1, 2, and 3.

EXAMPLE 2

To illustrate the dimensional behavior of poly(ethylene terephthalate) film supports of the type described herein under processing conditions according to the invention, samples 1, 2, and 3 were each divided into a number of portions. A portion from each sample was heated at 180° C for 6 seconds, at a preselected level of tension in the longitudinal dimension and with no tension or restraint in the transverse dimension. The destructive procedure was repeated on another portion of each sample at another level of tension, and so on, at different levels of tension. For each sample, a graph of transverse dimensional change of each portion versus longitudinal tension, such as illustrated in FIG. 2, was constructed. The graphs showed that samples 1, 2, and 3 undergo zero dimensional change (necking eliminated) when maintained under longitudinal tension of, respectively, about 440 psi, 630 psi and 335 psi.

EXAMPLE 3

A thermosensitive element can be made comprising a film support corresponding to any of samples 1, 2, or 3 in Example 2, and at least one thermosensitive layer on at least one surface of the support. The thermosensitive layer, in this example, must be capable of forming a visible image by heating at 180° C for 6 seconds. When processed at 180° C for 6 seconds under the same conditions of unidimensional tension of Example 2, such a thermosensitive element can be expected to demonstrate substantially the same dimensional changes.

It will be appreciated by those skilled in the art that although the method of the invention can be practiced as shown in Example 2 to eliminate necking, it is not so limited. For example, it may be desirable to utilize other longitudinal tension levels (at which necking is not wholly eliminated) in order to also control the amount of longitudinal dimensional change that the film support herein will undergo when subjected to processing according to the invention. As shown in Table I above, the longitudinal dimension of the instant poly(ethylene terephthalate) film support shrinks when held unrestrained at temperatures within the range from 100° C to $T_2$. When these films are processed with tension applied in the longitudinal dimension, according to the invention, such shrinkage is counteracted to varying degrees depending on the level of tension. At any tension level, of course, necking is reduced but not necessarily eliminated, in the transverse dimension. A preferred tension is that tension at which the shrinkage in the longitudinal dimension is eliminated. A most preferred tension is that which gives "balanced" dimensional change to the processed film. That is, a tension level is preselected to permit a degree of shrinkage in the longitudinal dimension which is substantially equal in absolute value (including zero) to the amount of necking occurring in the transverse dimension at that tension level. In the most preferred embodiment, one skilled in the art can simply perform a routine trial and error study to determine the appropriate tension level for "balancing" the dimensional properties of his processed film.

While FIG. 1 and Example 2 illustrate a method of heat processing a thermosensitive image-forming element wherein the element is moved continuously through a high temperature zone, the invention is not so limited. In particular, individual thermosensitive elements, such as found in the graphic arts, may be processed according to the invention by placing them under longitudinal (first dimension) tension, typically to maintain planarity, and holding them motionless in the high temperature zone until image development is complete.

In this regard, the geometric shape of an individual element may vary. For example, the shape of the element may be square or rectangular. In either case, the use of the terms "longitudinal" and "transverse" is not in reference to the magnitude of the dimensions, but is in reference to the direction in which tension is applied.

The invention has been described in detail with particular reference to preferred embodiments thereof, but it will be understood that variations and modifications can be effected within the spirit and scope of the invention.

What is claimed is:

1. In a process for forming a visible image in a thermosensitive element comprising at least one thermosensitive image-forming layer and a biaxially-oriented, heatset polyethylene terephthalate film support by (1) heating said element at a processing temperature of at least 100° but not greater than 230° C while maintaining said support under tension in the range from about 50 psi to about 600 psi in its longitudinal dimension and unrestrained in its transverse dimension, and (2) thereafter cooling said element to below 100° C, the improvement wherein said support is one which expands from about 0.1 percent to about 1.3 percent in said transverse dimension and shrinks from about 0.2 percent to about 3.3 percent in said longitudinal dimension when it is subjected to heating in an unrestrained state for 6 seconds at said processing temperature, and thereafter cooled to below 100° C, whereby necking of said element in its transverse dimension during said processing is reduced.

2. The process of claim 1 wherein said processing temperature is in the range from about 150° to about 200° C.

3. The process of claim 1 wherein said processing temperature is in the range from about 175° to about 185° C and wherein the tension in said longitudinal dimension is in the range from about 300 psi to about 500 psi.

4. The process of claim 1 wherein said thermosensitive layer is photothermographic.

5. The process of claim 1 wherein said thermosensitive layer is thermographic.

6. The process of claim 1 wherein said support in said thermosensitive element has a thickness from about 1.0 mil to about 8.0 mils.

7. The process of claim 1 wherein said support in said thermosensitive element has a thickness from about 2.5 mils to about 4.0 mils.

8. A thermosensitive image-forming element which exhibits reduced tendency toward necking upon heat processing under unidimensional tension in its longitudinal dimension, said element comprising (1) a biaxially-oriented, heatset polyethylene terephthalate film support which expands from about 0.1 percent to about 1.3 percent in its transverse dimension and shrinks from about 0.2 percent to about 3.3 percent in its longitudinal dimension upon being heated in an unrestrained state for 6 seconds at a temperature which is at least 100° but which does not exceed 230° C, and thereafter cooled to below 100° C, and (2) at least one thermosensitive image-forming layer.

9. The thermosensitive element of claim 8 wherein said support expands in its transverse dimension and shrinks in its longitudinal dimension upon being heated in an unrestrained state for 6 seconds at a temperature which is at least 100° but not greater than 200° C.

10. The thermosensitive element of claim 8 wherein said support expands in its transverse dimension and shrinks in its longitudinal dimension upon being heated in an unrestrained state for 6 seconds at a temperature which is at least 100° but not greater than 185° C.

11. The thermosensitive element of claim 8 wherein said thermosensitive layer is photothermographic.

12. The thermosensitive element of claim 8 wherein said thermosensitive layer is thermographic.

13. The thermosensitive element of claim 8 wherein said support has a thickness of from about 1.0 mil to about 8.0 mils.

14. The thermosensitive element of claim 8 wherein said support has a thickness from about 2.5 mils to about 4.0 mils.

* * * * *